US007542701B2

(12) United States Patent
Kweon

(10) Patent No.: US 7,542,701 B2
(45) Date of Patent: Jun. 2, 2009

(54) PROCESS CARTRIDGE AND AN IMAGE FORMING APPARATUS HAVING THE SAME

(75) Inventor: Dae-seob Kweon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 397 days.

(21) Appl. No.: 11/436,635

(22) Filed: May 19, 2006

(65) Prior Publication Data

US 2007/0053717 A1 Mar. 8, 2007

(30) Foreign Application Priority Data

Sep. 8, 2005 (KR) ..... 10-2005-0083798

(51) Int. Cl.
*G03G 21/16* (2006.01)
*G03G 15/00* (2006.01)
*G03G 15/08* (2006.01)

(52) U.S. Cl. ..... 399/111; 399/117; 399/159; 399/279

(58) Field of Classification Search ..... 399/111, 399/113, 117, 159, 222, 252, 279
See application file for complete search history.

(56) References Cited

U.S. PATENT DOCUMENTS 4,814,816 A * 3/1989 Idenawa ..... 399/279 X
5,678,148 A * 10/1997 Owada et al. ..... 399/279
6,882,811 B2 4/2005 Fukuda et al.
6,980,759 B2 * 12/2005 Kanno et al. ..... 399/111

FOREIGN PATENT DOCUMENTS

| | | |
|---|---|---|
| JP | 05-232789 | 9/1993 |
| JP | 7-234552 | 9/1995 |
| JP | 2001-166566 | 6/2001 |
| JP | 2002-357958 | 12/2002 |
| JP | 2003-323017 | 11/2003 |
| KR | 1998-10652 | 4/1998 |
| KR | 2005-05583 | 1/2005 |

OTHER PUBLICATIONS

Office Action issued on Sep. 5, 2006 from Korean Intellectual Property Office for Korean Patent Application No. KR 2005-83798.

* cited by examiner

*Primary Examiner*—Sandra L Brase
(74) *Attorney, Agent, or Firm*—Stein McEwen, LLP

(57) ABSTRACT

A process cartridge and an image forming apparatus including the same, the process cartridge comprising a side plate; a developing roller rotatably supported at the side plate; a photoconductive body having a center axle rotatably supported at the side plate so as to be located adjacent to the developing roller; and a center shifting member for moving the center axle of the photoconductive body from a first position to a second position so as to separate a developing nip between the photoconductive body and the developing roller. The image forming apparatus includes the process cartridge, so that it can establish and maintain the developing nip between the photoconductive body and the developing roller to print an image or separate the developing nip to circulate the process cartridge in the market.

26 Claims, 7 Drawing Sheets

PROCESS CARTRIDGE AND AN IMAGE FORMING APPARATUS HAVING THE SAME

CROSS-REFERENCE TO RELATED APPLICATION

This application claims the benefit of Korean Application No. 2005-83798, filed Sep. 8, 2005, in the Korean Intellectual Property Office, the disclosure of which is incorporated herein by reference.

BACKGROUND OF THE INVENTION

1. Field of the Invention

Aspects of the present invention relate to an image forming apparatus. More particularly, the present invention relates to a process cartridge capable of readily rendering a developing nip that is otherwise separated during shipping, distribution, and storage while circulated in the market, and an image forming apparatus having the same.

2. Description of the Related Art

In a conventional image forming apparatus which adopts an electrophotographic process, such as a laser printer, a copying machine or a facsimile, a process cartridge is used to combine a photoconductive body and a processing means into one cartridge capable of being installed into and removed from a main body of the image forming apparatus. This process cartridge is intended to simplify replacement of parts by combining various rollers of approximately the same life span including, for example, the photoconductive body and the developing roller, and a certain amount of toner into a single cartridge. An internal configuration of important parts of such a conventional process cartridge is illustrated in FIGS. 1 and 2.

In the cartridge shown in FIG. 1, a laser beam is scanned on a surface of a photoconductive drum 10 rotatably installed between two side plates 14, 16, to form a latent electrostatic image thereon. Then, a developing roller 12 in contact with the photoconductive drum 10 supplies the toner thereon to change the latent electrostatic image into a visible image.

The conventional process cartridge adopts a "contact development method", which usually has advantages of low noise, low power consumption, compactness in size and high definition, compared with a non-contact development method. However, in the contact development method, the amount of a toner supplied to the photoconductive body for developing the latent electrostatic image is very sensitive to the size of the developing nip D (see FIG. 2), i.e., an amount of contact surface between the photoconductive body and the developing roller. Therefore, to produce a high quality printed image using the contact development method, a predetermined developing nip D should be maintained between the developing roller and the photoconductive body. According to experimental results, a practically allowable range of the developing nip D is about +0.1 mm to about +0.2 mm in terms of an overlapping amount in the radial distance between the developing roller and the photoconductive body (i.e., an overlapping amount of outer radii of the developing roller and the photoconductive body on a line connecting the central axes of the developing roller and the photoconductive body). If the developing nip is outside of this range, there will be many significant deficiencies in the printed image. In practice, the conventional process cartridge has a specific developing nip fixed at the time of manufacture before it is initially put into circulation in the market; however the cartridge may not actually be used by a user until after a long period of time. Therefore, since the process cartridge may be in circulation for some time while the developing roller and the photoconductive body are in pressure contact with each other due to the initially set developing nip, several problems may arise, for instance the developing roller may be deformed by the pressure from the photoconductive body or the toner in the developing nip D may adhere to either the photoconductive body, the developing roller or both. Further, horizontal white lines or horizontal black lines may appear in the printed image due to migration between the photoconductive body and the developing roller.

To solve such problems, technologies for reducing the pressure on the developing roller due to the presence of the developing nip or reducing the amount of overlapping area have been developed. But, problems with these techniques, such as white voids appearing in both side portions of an image, remain unresolved. Therefore, to completely separate the developing nip when the cartridge is not in operation is one of the best ways of fundamentally solving the image defect problems caused by the developing nip. The developing nip is the interference between the photoconductive body and the developing roller, however when the bodies are separated so that there is no overlap, the developing nip itself is said to be separated.

A representative example of an image forming cartridge capable of separating the developing nip is disclosed in Japanese Patent Publication No. 2003-323017 (U.S. Pat. No. 6,882,811). FIGS. 3 and 4 illustrate such a process cartridge.

The cartridge shown in FIGS. 3 and 4 includes a plate 14; a photoconductive body 10 supported to be rotatable with respect to the plate 14; an eccentric cam 20 installed in the plate 14 and positioned in a first position A (operation position) or a second position B (retreat position); a developing roller 12 disposed to be rotatable with respect to the eccentric cam 20; and a lever connector 22 for positioning the eccentric cam 20 in the first or the second position. In the aforementioned cartridge, the eccentric cam 20 is moved to the first position A to cause the developing roller 12 to form a predetermined nip (indicated by dotted lines in FIG. 4) or to the second position B to cause the developing roller 12 to separate from the photoconductive body 10 (indicated by solid lines in FIG. 4). Therefore, when the cartridge is in an inoperative state, the developing nip between the photoconductive body 10 and the developing roller 12 can be separated by positioning the developing roller 12 in the retreat position.

However, a drawback in the aforementioned technology, is that since the eccentric cam 20 moves the center axis of the developing roller 12 from a point sh1 to a point sh2 as shown in FIG. 4, thus moving the developing roller 12 directly, a supply roller 15 and a blade 17 adjacent to the developing roller 12 are also affected. In addition, this may have an adverse effect on various gears coupled to the developing roller, the supply roller and the like, i.e., a gear train needed to drive the rotation of these cartridge components. Further, a seal sponge 18 or a pressing member for pressing a blade 17 is additionally required to prevent toner leakage due to the movement of the developing roller 12.

SUMMARY OF THE INVENTION

Accordingly, aspects of the present invention have been developed in order to solve the above and/or other problems associated with the related art. An aspect of the present invention is to provide a process cartridge which is capable of separating a developing nip completely and readily without having an adverse effect on a developing roller or other related parts.

Another aspect of the present invention is to provide an image forming apparatus which is capable of automatically maintaining or separating the developing nip when the process cartridge is installed into or removed from a main body frame, respectively.

An aspect of the present invention is achieved by providing a process cartridge, comprising a side plate; a developing roller rotatably supported at the side plate; a photoconductive body having a center axle rotatably supported at the side plate so as to be located adjacent to the developing roller; and a center shifting member for moving the center axle of the photoconductive body from a first position to a second position so as to separate a developing nip between the photoconductive body and the developing roller.

According to an aspect of the invention, the center shifting member may be coupled to the center axle of the photoconductive body such that the photoconductive body is rotatable, and the center shifting member is rotated by a predetermined distance into the first position to move the center axle of the photoconductive body toward the developing roller and is rotated by the predetermined distance into the second position to move the center axle of the photoconductive body away from the developing roller.

According to an aspect of the invention, the center shifting member may be installed in the side plate by inserting the outer circumferential surface thereof into the side plate.

Herein, the center shifting member may include a bushing which has centers of an inner circumferential surface and an outer circumferential surface that are different from each other; and a lever extending outwards from the outer circumferential surface of the bushing.

Further, an image forming apparatus comprises a main body frame provided with a guide rail formed on a side surface thereof; and a process cartridge which maintains a developing nip when installed in the main body frame along the guide rail, and which separates the developing nip when removed from the main body frame.

According to an aspect of the invention, the process cartridge may be installed in the main body frame along the guide rail to rotate the lever such that the center axle of the photoconductive body is moved toward the developing roller to be positioned in a first position, and when the process cartridge is removed from the main body frame, the center axle of the photoconductive body is rotated such that the center axle of the photoconductive body is moved away from the developing roller to be positioned in a second position.

According to an aspect of the invention, the main body frame is provided with a center shifting member installation part for positioning the center axle of the photoconductive body in the first position when the process cartridge is installed therein and positioning the center axle of the photoconductive body in the second position when the process cartridge is removed therefrom.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 9A and 9B are detailed views of the side plate of the process cartridge, shown in FIG. 5, with the center shifting member mounted thereon, wherein FIG. 9A is a perspective view of the left plate and FIG. 9B is a perspective view of the right plate;

DETAILED DESCRIPTION OF THE EMBODIMENTS

Figure 1:
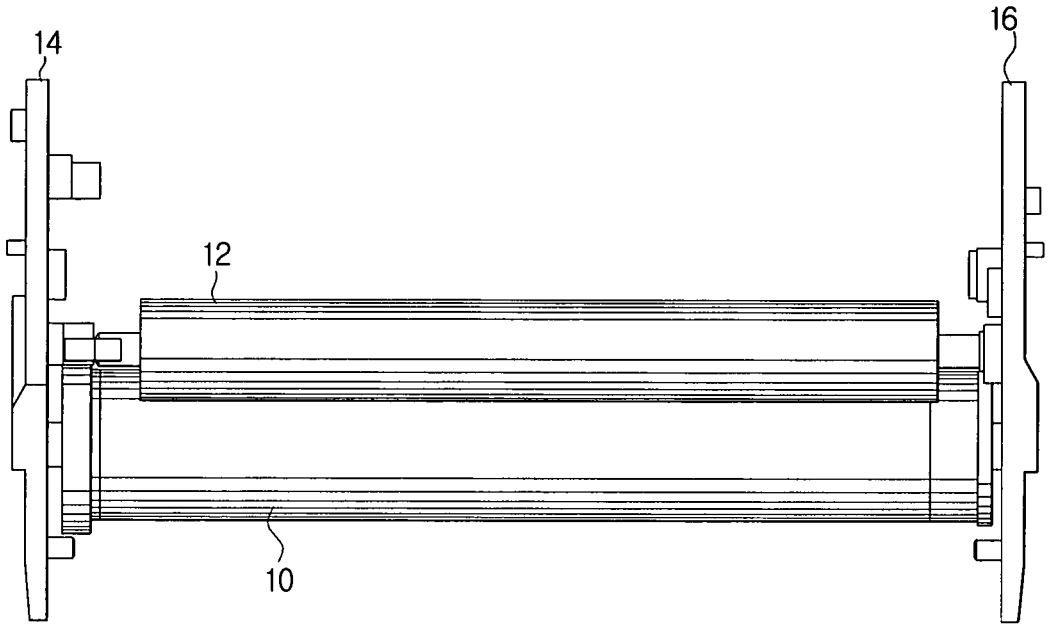
FIG. 1 (PRIOR ART)
FIG. 1 is a front view illustrating an internal configuration of important parts of a conventional process cartridge.
Figure 2:
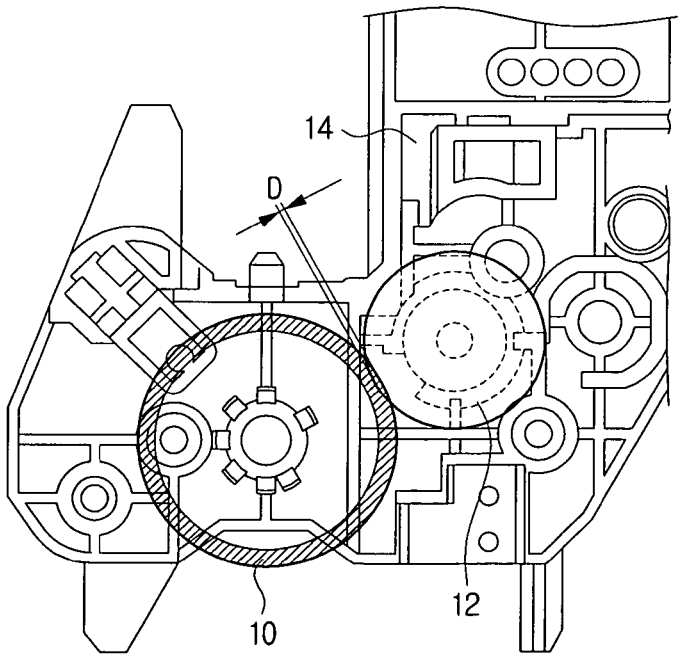
FIG. 2 (PRIOR ART)
FIG. 2 is a side view of FIG. 1, explaining a developing nip between a developing roller and a photoconductive body.
Figure 3:
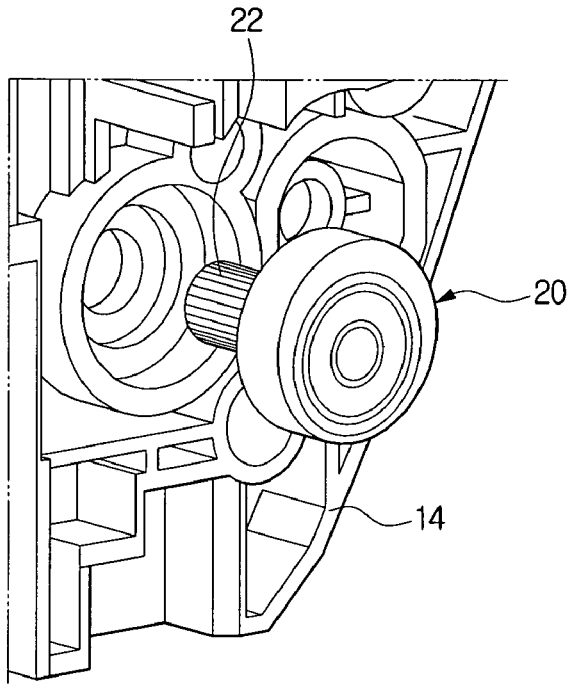
FIG. 3 (PRIOR ART)
FIG. 3 is a partial perspective view of the conventional process cartridge equipped with an eccentric cam for separating the developing nip.
Figure 4:
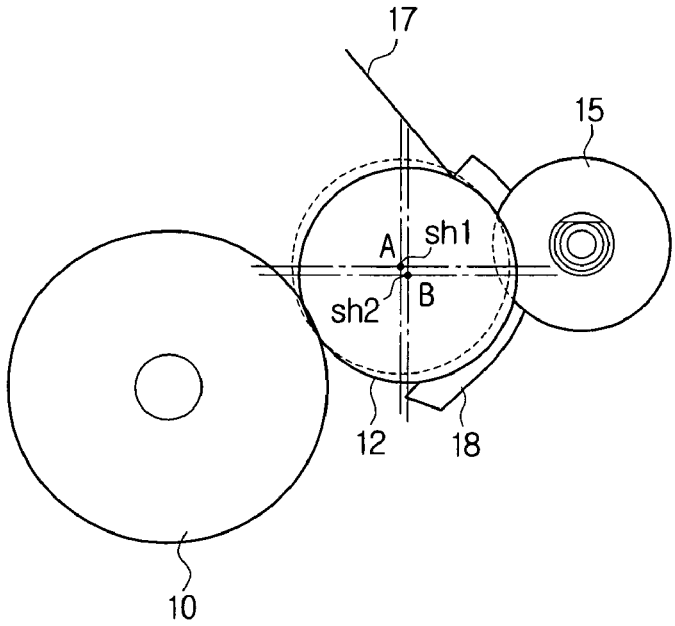
FIG. 4 (PRIOR ART)
FIG. 4 is a view for explaining operation of the eccentric cam of the process cartridge shown in FIG. 3.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 5:
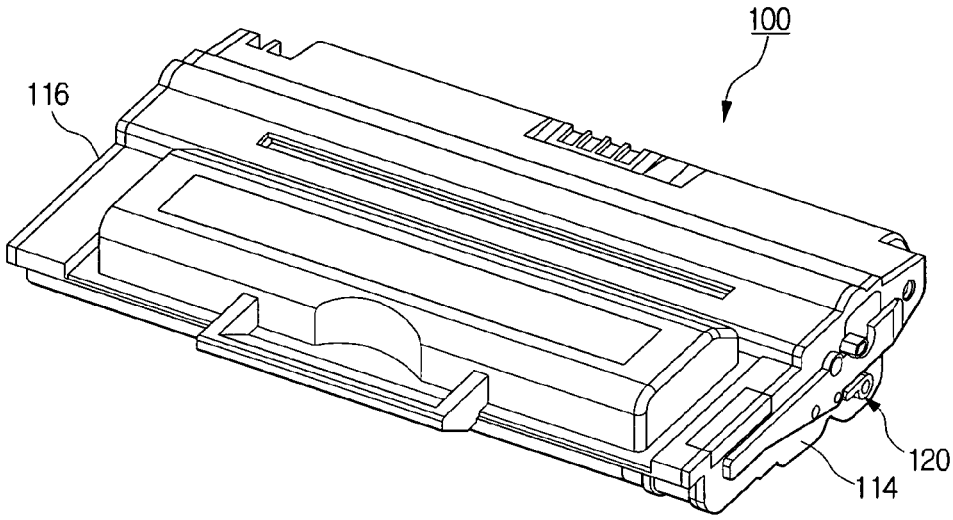
FIG. 5 is a perspective view of a process cartridge in accordance with an embodiment of the present invention.
Figure 6:
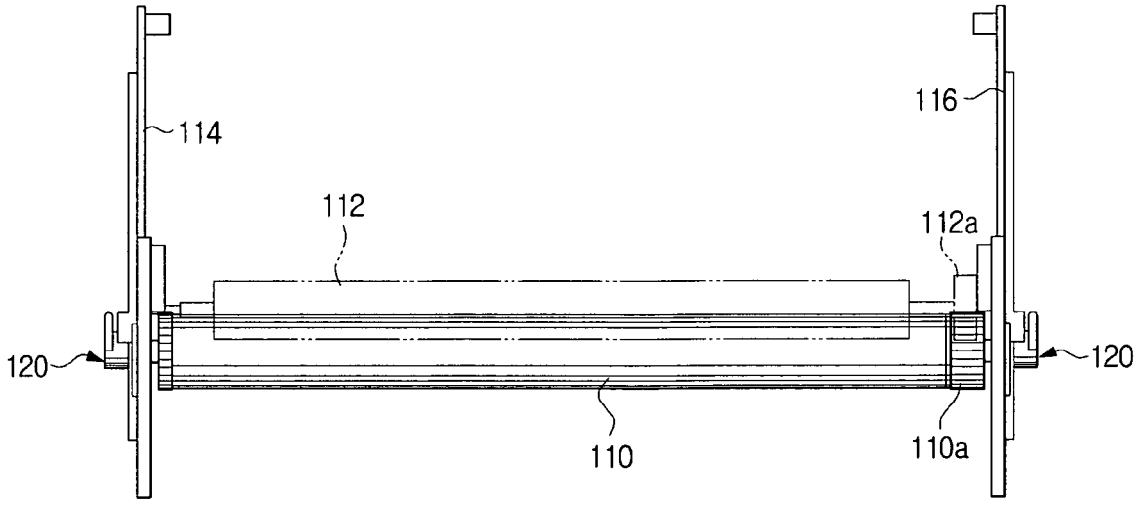
FIG. 6 is a front view illustrating an internal configuration of important parts of the process cartridge shown in FIG. 5.

FIG. 5 is a perspective view of a process cartridge in accordance with an embodiment of the present invention, and FIG. 6 is a front view illustrating an internal configuration of important parts of the process cartridge.

Referring to the drawings, a process cartridge 100 of the present invention includes side plates 114, 116, a developing roller 112, a photoconductive body 110 and a center shifting member 120.

Figure 7:
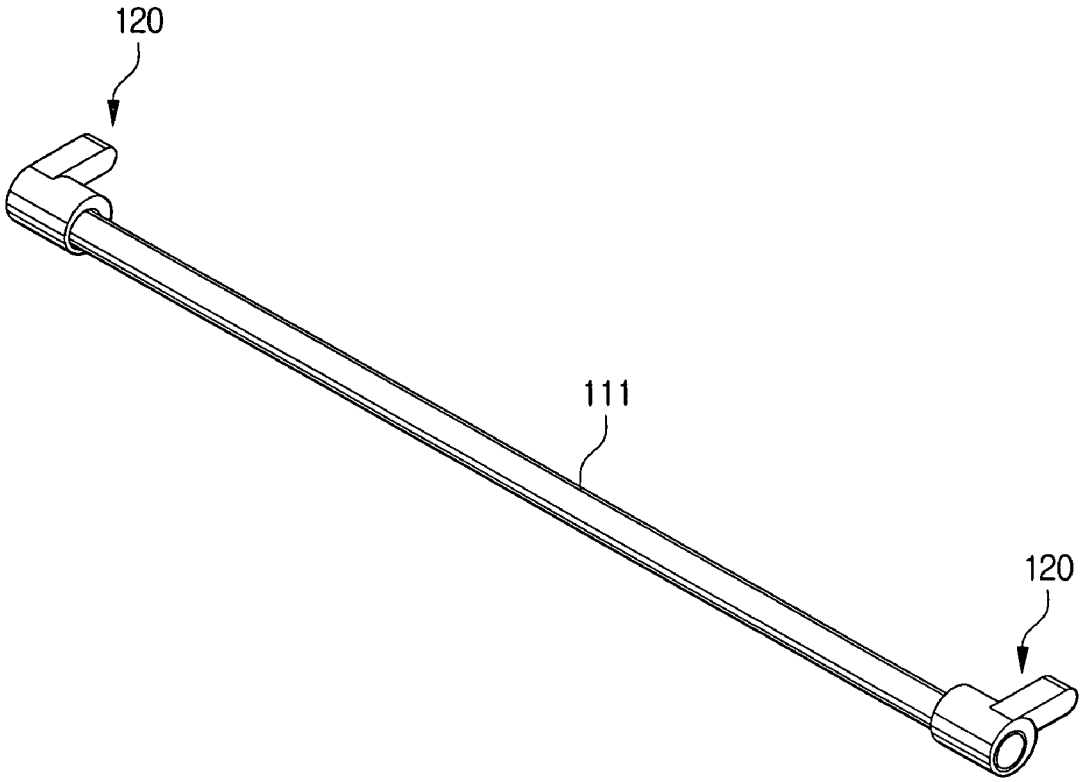
FIG. 7 is a perspective view of a center axle of a photoconductive body, shown in FIG. 6, with a center shifting member mounted thereon.

The side plates 114 and 116 form an outer appearance of the process cartridge 100, and support both end portions of the developing roller 112 and the photoconductive body 110 such that the developing roller 112 and the photoconductive body 110 are rotatable. The developing roller 112 is rotatably supported by the side plates 114 and 116 at both end portions thereof, and located adjacent to the photoconductive body 110. The photoconductive body 110 is located adjacent to the developing roller 112, and a center axle 111 of the photoconductive body 110 is rotatably supported by the side plates 114, 116. The center axle 111 of the photoconductive body is shown in FIG. 7. On one end portion of the center axle 111 of the photoconductive body 110, a photoconductive body gear 110*a* is installed, which is meshed with an axle gear 112*a* of the developing roller 112. A further description of the details of the process cartridge 100 which fall within the scope of conventional technology will be omitted in this specification.

In an embodiment of the present invention, the photoconductive body 110 is coupled with center shifting members 120 at both end portions thereof. FIG. 7 illustrates in detail a configuration of the center axle 111 of the photoconductive body 110 coupled with the center shifting members 120.

Figure 8:
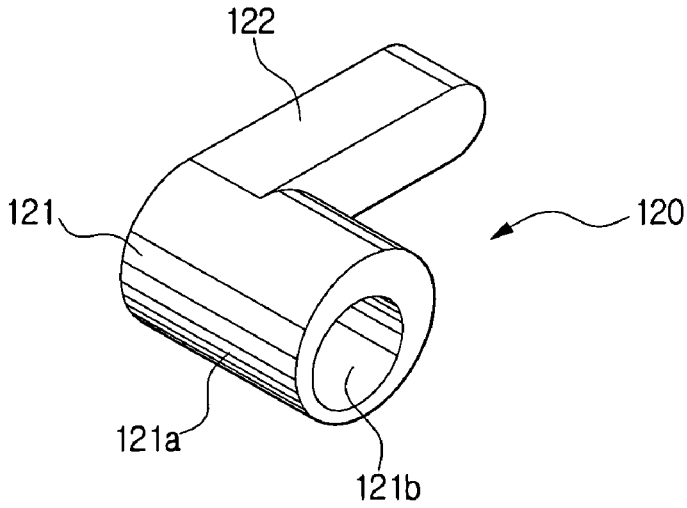
FIG. 8 is a detailed perspective view of the center shifting member shown in FIG. 7.

Further, FIG. 8 shows in detail a configuration of each of the center shifting members 120. Referring to the drawings, each center shifting member 120 is provided with a bushing 121 and a lever 122 extending outwards from the bushing 121. The bushing 121 is shaped into a cylinder having axial centers of an outer circumferential surface 121*a* and an inner circumferential surface 121*b* that do not coincide with each other. The outer circumferential surface 121*a* of the bushing 121 of each of the center shifting members 120 is inserted into a respective opening formed in each of the side plates 114 and 116. Into the inner circumferential surface 121*b* of the bushing 121 of each of the center shifting members 120, the respective end of the center axle 111 of the photoconductive body 110 is rotatably inserted. On the inner circumferential surface 121*b* of the bushing 121, a protrusion (not shown) can be formed, which acts as a key for preventing the center shifting member 120 from being detached from the center axle 111 in a length direction of the center axle 111. The lever 122 is connected to the eccentric bushing 121 and transmits an external force to the bushing 121 to rotate the bushing 121 a predetermined distance.

Operation of the process cartridge equipped with the center shifting members 120 will be described in detail with reference to the accompanying drawings.

Figure 9A:
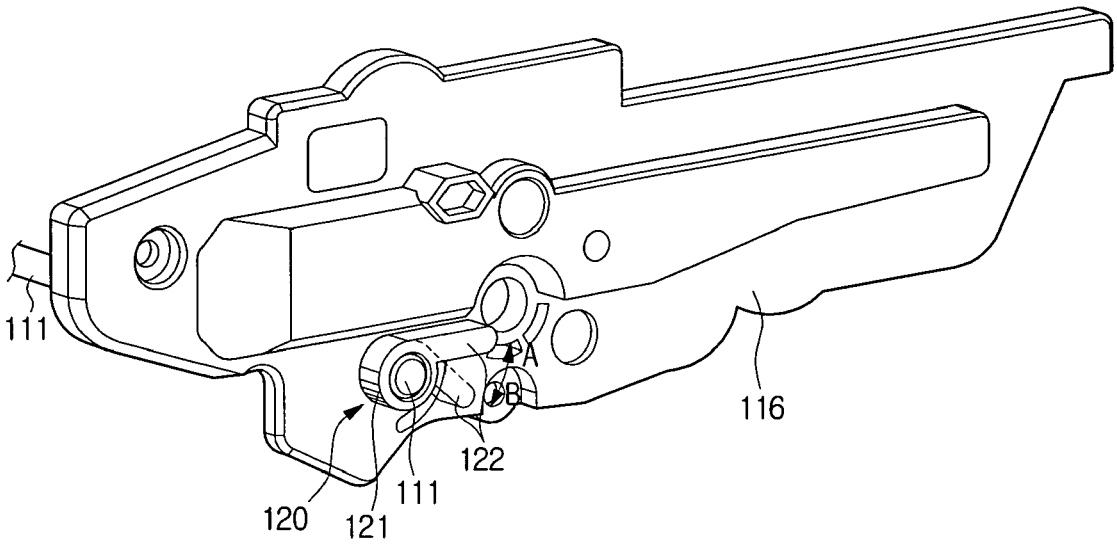
Figure 9B:
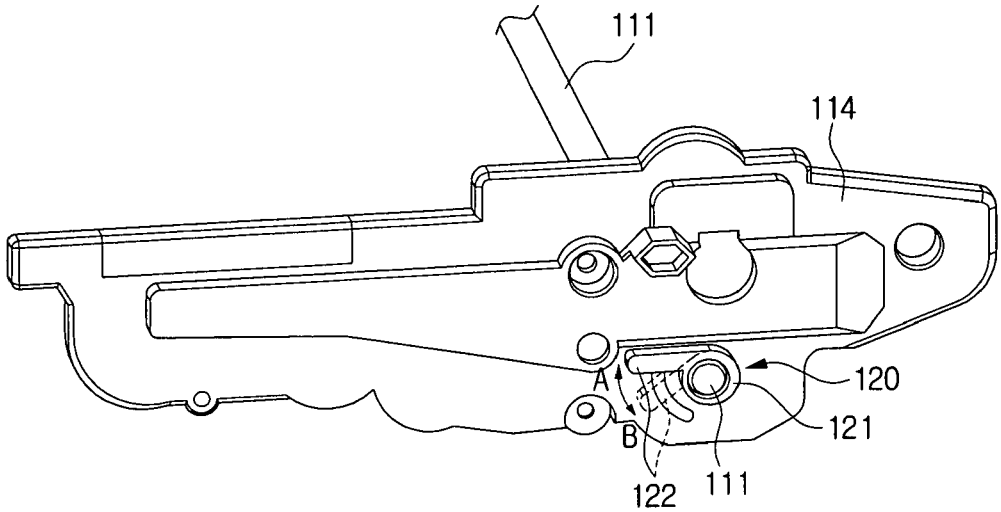
Figure 10:
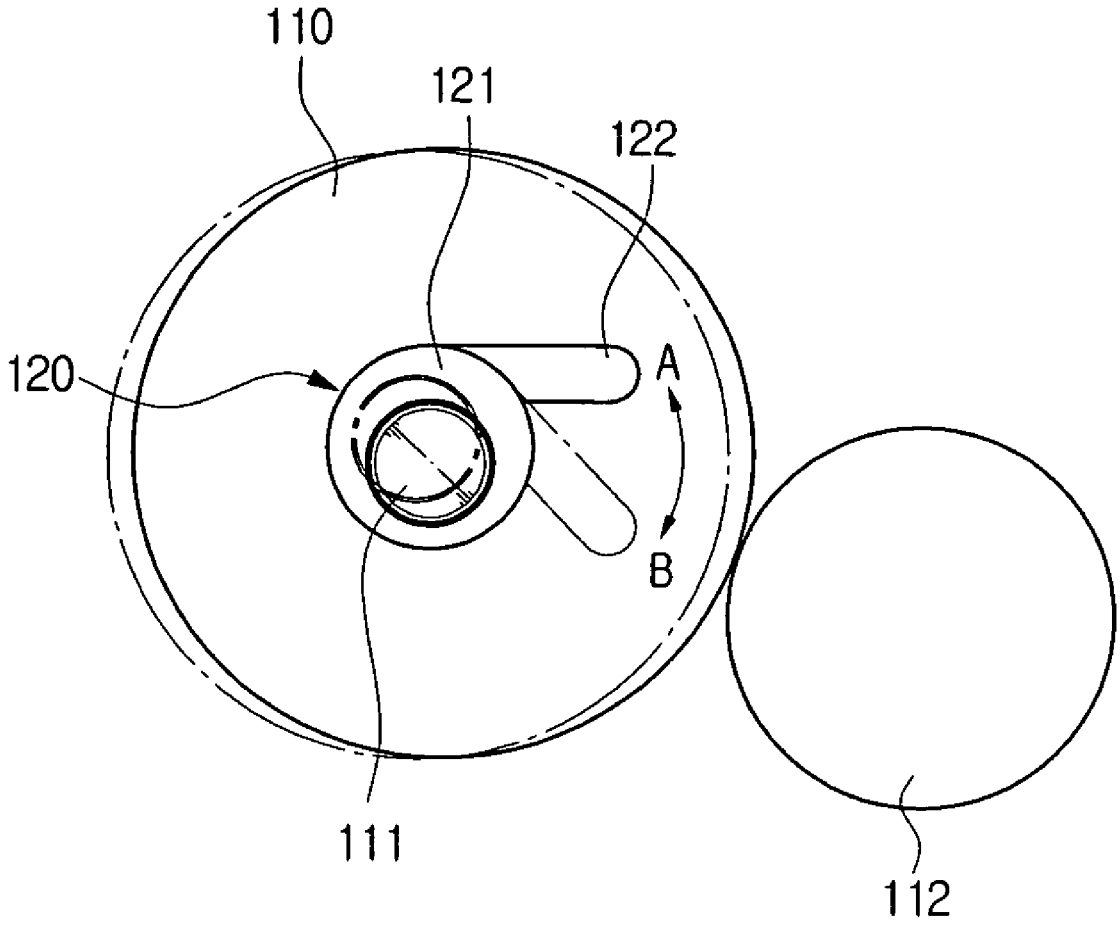
FIG. 10 is a view for explaining operation of the center shifting member in accordance with an embodiment of the present invention.

FIGS. 9A and 9B are detailed views of the side plates of the process cartridge, wherein FIG. 9A is a perspective view of the left plate and FIG. 9B is a perspective view of the right plate, and FIG. 10 is a view for explaining an operation of the center shifting member.

As shown in FIGS. 9A and 9B, the center shifting members 120 are inserted in the respective openings of the side plates 114 and 116 and coupled with the center axle 111 such that the center axle 111 of the photoconductive body 110 is rotatable in the inner circumferential surfaces 121*b* of the center shifting members 120. The bushing 121 of the center shifting member 120 is eccentric, that is, the axial centers of the outer circumferential surface 121*a* and the inner circumferential surface 121*b* of the bushing 121 do not coincide with each other. Therefore, when the bushing 121 is rotated by a predetermined distance, the center of the outer circumferential surface 121*a* of the bushing 121 is not changed, while the axial center of the inner circumferential surface 121*b* eccentrically disposed from the outer circumferential surface 121*a* is moved by a predetermined distance.

In other words, when the levers 122 of the center shifting members 120 on either end of the center axle 111 are rotated from a first position A to a second position B by a predetermined distance as shown in FIGS. 9A, 9B and 10, the center axle 111 of the photoconductive body 110 is moved to a predetermined position along with the inner circumferential surfaces 121*b*. As a result of the center axle 111 translation, the photoconductive body 110 abuts the developing roller 112 so as to maintain a developing nip therebetween (indicated by solid lines in FIG. 10) when the levers 122 are in the first position A. When the levers 122 are in the second position B, the center axle 111 of the photoconductive body 110 is spaced farther from the developing roller 112 so as to separate the developing nip (indicated by the dashed lines in FIG. 10). Therefore, according to an aspect of the present invention, a small rotation of the center shifting members 120 translates the center axle 111 of the photoconductive body 110, readily maintaining or separating the developing nip. In the example shown, two center shifting members 120 are rotatably attached on either end of the center axle 111 to move the photoconductive body 110, however it is understood that the present invention is not limited to the two center shifting members 120 shown in this embodiment, that is, at least one center shifting member 120 will suffice according to some embodiments of the present invention.

In accordance with a developing nip separation aspect of the present invention, since the center axle 111 of the photoconductive body 110 is moved away from the developing roller 112, it does not affect a supply roller or a blade, disposed adjacent to the developing roller 112, nor the developing roller 112. Further, a gear train coupled to the developing roller and the supply roller is not affected, and toner leakage due to the movement of the developing roller can be prevented. Therefore, no additional seal member or pressing member is required.

Meanwhile, an image forming apparatus in accordance with an aspect of the present invention is configured such that a predetermined developing nip can be established and maintained when the process cartridge is installed therein.

Figure 11:
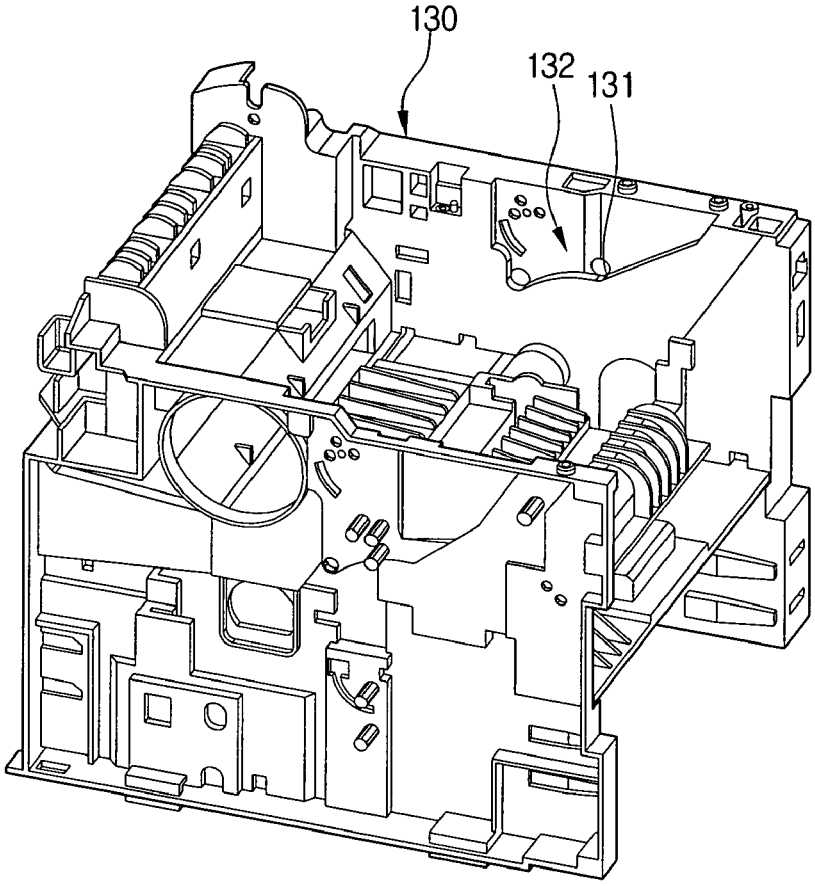
FIG. 11 is a perspective view of a main body frame of the image forming apparatus of an aspect of the present invention.
Figure 12:
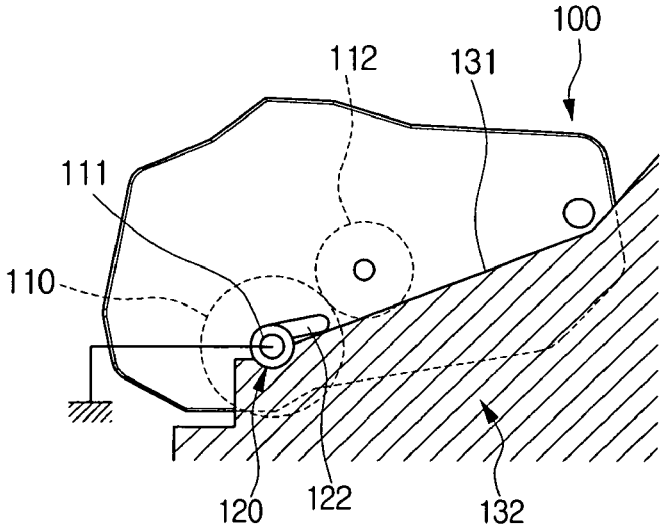
FIG. 12 is a side view of the process cartridge installed in the main body frame shown in FIG. 11.

FIG. 11 is a perspective view of a main body frame 130 of the image forming apparatus according to an aspect of the present invention, and FIG. 12 is a side view of the process cartridge 100 installed in the main body frame along a guide rail of the main body frame 130.

Referring to the drawings, on both side surfaces of a main body frame 130 of the image forming apparatus, guide rails 131 slanted at a predetermined angle are formed. At an end portion of each of the guide rails 131, a center change member installation part 132 is formed, in which the respective center shifting member 120 is seated in a stationary position. The center change member installation part 132 is approximately semi-circular.

As shown in FIG. 12, when being installed into the main body frame 130, the process cartridge 100 is inserted thereinto sliding along the guide rails 131. At this time, when the center shifting members 120 of the process cartridge 100 are seated at the center change member installation parts 132 formed at the end portion of each of the guide rails 131 of the main body frame 130, the lever 122 of each center shifting member 120 is positioned in the first position A, thus maintaining the predetermined developing nip between the photoconductive body 110 and the developing roller 112 of the process cartridge 100. In contrast, when the process cartridge 100 is removed from the main body frame 130, the lever 122 of each center shifting member 120 is rotated into the second position B, thus readily separating the developing nip between the photoconductive body 110 and developing roller 112. In the image forming apparatus according to an aspect of the present invention, the developing nip between the photoconductive body and the developing roller of the process cartridge is separated, thus keeping the photoconductive body out of contact with the developing roller, while the process cartridge is in circulation in the market, but after the process cartridge is installed into the main body frame, the developing nip can be maintained within a predetermined range.

As described above, since the developing nip is separated by the movement of the center axle of the photoconductive body in the process cartridge of the present embodiment, the developing roller, as well as other parts, is unaffected.

Further, in accordance with an aspect of the present invention, since the developing nip is automatically maintained or separated when the process cartridge is installed into or removed from the main body frame, the developing nip is readily managed. Therefore, it is possible to prevent problems associated with conventional process cartridges, such as images with horizontal white lines or horizontal black lines due to the developing nip.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A process cartridge, comprising:

a side plate;

a developing roller rotatably supported at the side plate;

a photoconductive body having a center axle rotatably supported at the side plate so as to be located adjacent to the developing roller; and a center shifting member to move the center axle of the photoconductive body from a first position to a second position so as to separate a developing nip between the photoconductive body and the developing roller.

2. The process cartridge according to claim 1, wherein the center shifting member is coupled to the center axle of the photoconductive body such that the photoconductive body is rotatable, and the center shifting member is rotated by a predetermined distance from the second position into the first position to move the center axle of the photoconductive body toward the developing roller and is rotated by the predetermined distance from the first position into the second position to move the center axle of the photoconductive body away from the developing roller.

3. The process cartridge according to claim 2, further comprising:

a second side plate to rotatably support another end of the center axle of the photoconductive body; and a second one of the center shifting member, wherein each of the center shifting members is respectively coupled to each end of the center axle of the photoconductive body, and the center shifting members are rotated by the predetermined distance from the second position into the first position to move the center axle of the photoconductive body toward the developing roller and are rotated by the predetermined distance from the first position into the second position to move the center axle of the photoconductive body away from the developing roller.

4. The process cartridge according to claim 2, wherein the center shifting member comprises:

a bushing which has centers of an inner circumferential surface and an outer circumferential surface that are different from each other; and a lever extending outwards from the outer circumferential surface of the bushing.

5. The process cartridge according to claim 4, wherein the inner circumferential surface of the bushing of the center shifting member comprises:

a protrusion to prevent the center shifting member from detaching from the center axle of the photoconductive body in an axial direction.

6. The process cartridge according to claim 4, wherein the center shifting member is installed in the side plate by inserting the outer circumferential surface thereof into the side plate.

7. A process cartridge, comprising:

a side plate;

a developing roller rotatably supported at the side plate;

a photoconductive body rotatably supported at the side plate so as to be located adjacent to the developing roller; and a photoconductive body movement element to move the photoconductive body relative to the developing roller to separate a developing nip between the photoconductive body and the developing roller.

8. The process cartridge according to claim 7, further comprising:

a second side plate to rotatably support another end of the photoconductive body; and a second one of the photoconductive body movement element, wherein each of the photoconductive body movement elements is respectively coupled to each end of the photoconductive body, and the photoconductive body movement elements are moved by a predetermined distance from a second position into a first position to move the photoconductive body toward the developing roller and are moved by the predetermined distance from the first position into the second position to move the photoconductive body away from the developing roller.

9. An image forming apparatus, comprising:

a main body frame provided with a guide rail formed on a side surface thereof; and a process cartridge comprising a photoconductive body and which maintains a developing nip when installed in the main body frame along the guide rail, and which separates the developing nip by moving the photoconductive body when removed from the main body frame.

10. The image forming apparatus according to claim 9, wherein the process cartridge further comprises:

a side plate;

a developing roller rotatably supported at the side plate; and a center shifting member to move a center axle of the photoconductive body from a first position to a second position so as to separate the developing nip between the photoconductive body and the developing roller, wherein the center axle of the photoconductive body is rotatably supported at the side plate so as to be located adjacent to the developing roller.

11. The image forming apparatus according to claim 10, wherein the center shifting member is coupled to the center axle of the photoconductive body such that the photoconductive body is rotatable, and the center shifting member is rotated by a predetermined distance from the second position into the first position to move the center axle of the photoconductive body toward the developing roller and is rotated by the predetermined distance from the first position into the second position to move the center axle of the photoconductive body away from the developing roller.

12. The image forming apparatus according to claim 11, wherein the process cartridge further includes:

a second side plate to rotatably support another end of the center axle of the photoconductive body; and a second one of the center shifting member, wherein each of the center shifting members is respectively coupled to each end of the center axle of the photoconductive body, and the center shifting members are rotated by the predetermined distance from the second position into the first position to move the center axle of the photoconductive body toward the developing roller and are rotated by the predetermined distance from the first position into the second position to move the center axle of the photoconductive body away from the developing roller.

13. The image forming apparatus according to claim 10, wherein the center shifting member includes:

a bushing which has centers of an inner circumferential surface and an outer circumferential surface that are different from each other; and a lever extending outwards from the outer circumferential surface of the bushing.

14. The image forming apparatus according to claim 13, wherein the center shifting member is installed in the side plate by inserting the outer circumferential surface thereof into the side plate.

15. The image forming apparatus according to claim 13, wherein when the process cartridge is installed in the main body frame along the guide rail, the lever is rotated such that the center axle of the photoconductive body is moved toward the developing roller to be positioned in a first position, and when the process cartridge is removed from the main body frame, the center axle of the photoconductive body is rotated such that the center axle of the photoconductive body is moved away from the developing roller to be positioned in a second position.

16. The image forming apparatus according to claim 10, wherein the main body frame is provided with a center change member installation part to position the center axle of the photoconductive body in the first position when the process cartridge is installed therein.

17. The image forming apparatus according to claim 16, wherein the center change member installation part is approximately semi-circular.

18. The image forming apparatus according to claim 9, wherein the process cartridge further comprises:

a side plate;

a developing roller rotatably supported at the side plate so as to be located adjacent to the photoconductive body; and a photoconductive body movement element to move the photoconductive body relative to the developing roller to separate the developing nip between the photoconductive body and the developing roller.

19. A method of establishing a developing nip in a process cartridge having a developing roller and a photoconductive body movement element for moving a photoconductive body, comprising:

moving the photoconductive body movement element in the process cartridge by a predetermined distance to cause the photoconductive body in the process cartridge to impinge on the developing roller in the process cartridge to create the developing nip.

20. The method claim as defined in claim 19, further comprising:

rotating a center shifting member to move a center axle of the photoconductive body in the process cartridge by a second predetermined distance to cause the photoconductive body in the process cartridge to impinge on the developing roller in the process cartridge to create the developing nip.

21. The method as defined in claim 20, further comprising:

inserting the process cartridge in a main body of an image forming apparatus having a guide rail and a center change member installation part;

rotating the center shifting member the second predetermined distance by contact between the center shifting member and the center change member installation part to cause the photoconductive body in the process cartridge to impinge on the developing roller in the process cartridge to create the developing nip; and seating the process cartridge in the center change member installation part in the main body of the image forming apparatus to maintain the developing nip.

22. A method of separating a developing nip in a process cartridge having a developing roller and a photoconductive body movement element for moving a photoconductive body, comprising:

moving the photoconductive body movement element in the process cartridge by a predetermined distance to cause the photoconductive body in the process cartridge to move away from the developing roller in the process cartridge to separate the developing nip.

23. The method as defined in claim 22, further comprising:

rotating a center shifting member to move a center axle of the photoconductive body in the process cartridge by a second predetermined distance to cause the photoconductive body in the process cartridge to move away from the developing roller in the process cartridge to separate the developing nip.

24. The method as defined in claim 23, further comprising:

withdrawing the process cartridge from a main body of an image forming apparatus having a guide rail and center change member installation part; and rotating the center shifting member the second predetermined distance by contact between the center shifting member and the center change member installation part to cause the photoconductive body in the process cartridge to move away from the developing roller in the process cartridge to separate the developing nip.

25. A method of avoiding damage to a photoconductive body and a developing roller in a process cartridge having a developing roller and a photoconductive body movement element for moving a photoconductive body, during transporting, handling and storing, comprising:

moving the photoconductive body movement element in the process cartridge by a predetermined distance to cause the photoconductive body in the process cartridge to move away from the developing roller in the process cartridge to separate the developing nip.

26. The method as defined in claim 25, further comprising:

rotating a center shifting member to move a center axle of the photoconductive body in the process cartridge by a second predetermined distance to cause the photoconductive body in the process cartridge to move away from the developing roller in the process cartridge to separate the developing nip.

* * * * *